US010952521B2

(12) United States Patent
Haag et al.

(10) Patent No.: US 10,952,521 B2
(45) Date of Patent: Mar. 23, 2021

(54) BACKPACK COVER WITH SECURITY AND SAFETY FEATURES

(71) Applicant: John Dacen Haag, Mountain Home, ID (US)

(72) Inventors: John Dacen Haag, Mountain Home, ID (US); Harley Morgan, Mountain Home, ID (US)

( * ) Notice: Subject to any disclaimer, the term of this patent is extended or adjusted under 35 U.S.C. 154(b) by 34 days.

(21) Appl. No.: 16/545,984

(22) Filed: Aug. 20, 2019

(65) Prior Publication Data

US 2020/0054115 A1 Feb. 20, 2020

Related U.S. Application Data

(60) Provisional application No. 62/720,048, filed on Aug. 20, 2018, provisional application No. 62/838,945, filed on Apr. 26, 2019.

(51) Int. Cl.
*A45F 3/04* (2006.01)
*A45F 3/00* (2006.01)

(52) U.S. Cl.
CPC ..... *A45F 3/04* (2013.01); *A45F 2003/001* (2013.01)

(58) Field of Classification Search
CPC ..... A45F 3/04; A45F 2003/001; A45C 13/002
USPC ..... 150/154
See application file for complete search history.

(56) References Cited

U.S. PATENT DOCUMENTS 4,213,549 A 7/1980 Hibbard
4,881,684 A * 11/1989 Chinman ..... A45C 3/00 190/115
5,010,987 A * 4/1991 Evans ..... A45C 13/002 150/105
5,154,332 A * 10/1992 Williams ..... A45C 13/002 190/26

(Continued)

FOREIGN PATENT DOCUMENTS

CA 2440921 A1 3/2005
DE 202016102820 U1 * 6/2016 ..... A45C 13/002

(Continued)

OTHER PUBLICATIONS

Internet product printouts for backpack rain covers, at least early as Nov. 6, 2017.

*Primary Examiner* — Justin M Larson
(74) *Attorney, Agent, or Firm* — Pedersen & Company, PLLC; Ken J. Pedersen; Barbara S. Pedersen

(57) ABSTRACT

A backpack cover protects the backpack and its contents, and/or the user. The cover envelops substantially the entire backpack, allowing the backpack shoulder straps to extend from the cover for use on the user's back. Front latches/locks deter removal of the cover from the backpack, as the latches/locks are between the backpack and the user's back during carrying of the covered backpack on the shoulders. The latches/locks or their connections to the main body of the cover preferably extend through the backpack shoulder straps to further secure the cover to the backpack. A single latch/lock may be selectively unlatched, allowing the cover top portion to be moved from the backpack top end, for quick access to the backpack's main opening and its contents. The cover may have an internal pocket for holding important items, or to contain a bullet-proof/resistant pad or plate, for added security and safety.

20 Claims, 12 Drawing Sheets

(56) References Cited

U.S. PATENT DOCUMENTS

| | | | | | |
|---|---|---|---|---|---|
| 5,255,765 | A * | 10/1993 | Schrecongost | A45C 13/002 | 150/154 |
| 5,439,153 | A * | 8/1995 | Murdoch | A45C 13/002 | 150/159 |
| D429,419 | S * | 8/2000 | Barraco | D3/318 | |
| 6,279,796 | B1 * | 8/2001 | Trevino | A45C 13/002 | 150/154 |
| 6,315,178 | B1 * | 11/2001 | Nobata | A45F 3/04 | 224/153 |
| D509,653 | S * | 9/2005 | Yu | D3/216 | |
| 7,422,131 | B2 | 9/2008 | Cohen | | |
| 8,152,374 | B2 * | 4/2012 | Shaul | A45C 13/002 | 383/37 |
| D680,332 | S * | 4/2013 | Webster | D3/318 | |
| D696,516 | S * | 12/2013 | Caspi | D3/318 | |
| D765,405 | S * | 9/2016 | DeSerio | D3/318 | |
| 10,188,196 | B2 * | 1/2019 | Thibadeau | A45F 3/04 | |
| 10,433,627 | B2 * | 10/2019 | Hays | A45C 13/002 | |
| 2005/0133558 | A1 * | 6/2005 | Toombs | A45C 13/002 | 224/576 |
| 2005/0199658 | A1 | 9/2005 | Brown et al. | | |
| 2006/0090824 | A1 * | 5/2006 | Kreft | A47J 37/0786 | 150/154 |
| 2007/0017764 | A1 * | 1/2007 | Cheng | A45C 13/002 | 190/100 |
| 2010/0232731 | A1 * | 9/2010 | Shaul | A45C 13/002 | 383/37 |
| 2012/0225226 | A1 * | 9/2012 | Fikry | A45C 13/002 | 428/35.2 |
| 2016/0360845 | A1 * | 12/2016 | Somers | A45C 13/002 | |
| 2019/0110565 | A1 * | 4/2019 | Cunha | A45C 13/002 | |
| 2019/0387865 | A1 * | 12/2019 | Panza, III | A45F 3/04 | |
| 2020/0205554 | A1 * | 7/2020 | Deioma | A45F 3/04 | |

FOREIGN PATENT DOCUMENTS

| | | | | | |
|---|---|---|---|---|---|
| EP | 1086633 | A1 | | 3/2001 | |
| FR | 2721183 | A1 | | 12/1995 | |
| JP | 07-308217 | A | | 11/1995 | |
| JP | 2001-258627 | A | | 9/2001 | |
| JP | 2002-119319 | A | | 4/2002 | |
| JP | 2002-199935 | A | | 7/2002 | |
| JP | 2004016621 | A | * | 1/2004 | A45C 13/002 |
| JP | 2004275237 | A | * | 10/2004 | A45F 3/04 |
| KR | 20140106218 | A | * | 9/2014 | A45C 3/08 |

* cited by examiner

BACKPACK COVER WITH SECURITY AND SAFETY FEATURES

This application claims benefit of Provisional Application Ser. No. 62/720,048, filed Aug. 20, 2018, and entitled Backpack Cover with Locking and Security Features, and claims benefit of Provisional Application Ser. No. 62/838,945, filed Apr. 26, 2019, and entitled Backpack Cover with Locking and Security Features, which two Provisional Applications are incorporated herein in their entirety by this reference.

FIELD OF THE INVENTION

The invention relates generally to covers for backpacks. More specifically, the invention relates to covers that are adapted for protecting the backpack and/or its contents, for example, from dirt, weather, moisture, theft, and/or damage.

SUMMARY

The invention comprises a cover, for use with a backpack, that is adapted for protecting the backpack and/or its contents. The cover may be especially beneficial for travel or use in dirty environments, inclement weather, and/or in a stressful, crowded or unfamiliar setting where security and/or safety are a concern.

The cover is adapted to cover/envelop substantially the entire backpack, but to conveniently and comfortably allow the backpack shoulder straps to extend from the cover for use on the wearer's back. The cover comprises one or more latches/locks, which are adapted and located to secure the cover on the backpack and to deter removal of the cover from the backpack for example by an unauthorized party, for example, due to the latches/locks being between the backpack and the wearer's back during carrying of the covered backpack on the shoulders, and therefore generally or entirely hidden from view. The covered backpack may be conveniently removed from the shoulders and the user may then selectively unlatch one or more latches, to move a top/upper portion of the cover away from one or more upper backpack openings, for quick access to the opening(s) and the contents of the backpack. Then, the top/upper portion of the cover may be quickly returned to extend over the upper portion of the backpack, and may then be latched in place around/over the upper portion of the backpack to again cover the openings.

In certain embodiments, said one or more latches/locks comprise multiple latches all generally centered on the front, that is the shoulder strap side, of the backpack and the cover. Thus, the latches may be described as in a close grouping, or "cluster", generally centered at the front of the backpack and cover, to be distanced from the right and left sides of the backpack and cover, distanced from the top end and the bottom end of the backpack and the cover. The multiple latches, specifically in preferred embodiments all of the right and left and top latches, are centered or generally centered in a region ("a latch area") of the front side of the cover that is less than 7 inches, or more preferably less than 5 inches in diameter, or less than 7 inches tall by 7 inches wide or more preferably less than 5 inches tall by 5 inches wide, for keeping said latches centered, close together for easy operation, and relatively inaccessible to others. The multiple latches in said grouping may comprise a right side latch and a left side latch, and a top end latch. This way, one or more of the multiple latches may be easily operated by the user, by focusing his/her efforts on that relatively small area of the front of the cover, without having to flip the backpack over to multiple sides. Ease and economy of movement and manipulation of the cover and the backpack contained therein may also equate to security and safety in a stressful, crowded or unfamiliar setting where security and/or safety are a concern.

The top latch of said grouping of latches is preferably independently unlatchable, while the right side and left side latches remain latched, so that the top end of the cover may be unlatched while the right and left sides and the bottom end of the cover remain in place on/over the backpack. This separate and independent unlatching of the top latch allows the user move/pull-back the top portion of the cover to allow access to the main, upper opening of the backpack, without disrupting the rest of the cover and without uncovering/exposing the entire, or even a substantial portion, of the backpack. This prevents having to remove and then reinstall the entire cover, or even a substantial portion of the cover, just to add, remove, or check an object from the backpack. Thus, the multiple latches and their placement, and especially the separate and independent operation of the top latch, contribute to convenience, quick use, and safety and security of the backpack contents and the user.

In certain embodiments, the top latch is connected to the main body of the cover by connection to a top extension, such as a top latch strap, that extends through a top handle of the backpack, which helps center said extension relative to the upper end of the backpack and thereby securely retains the top/upper portion of the cover on the backpack when the top latch is latched. In such embodiments, the cover preferably comprises a handle flap that extends from the main body of the cover to extend forward up and over the handle, covering and hiding the handle so that rain, dirt, and people do not access the handle or adjacent areas of the backpack.

In certain embodiments, the cover comprises an internal pocket for securing or hiding important items, to add security and safety options. For example, the user may choose to store a passport or money in that internal pocket. In certain embodiments, the pocket is made to be large, for example, about or nearly the same top-to-bottom dimension and the same right-to-left side dimension as the cover and/or the backpack, for holding a larger item. For example, the large pocket may receive bullet-proof/resistant pad, to provide the user with a protective shield in the event of an emergency, or a cushioning pillow/pad, for helping the user rest/sleep with his/her head on the covered backpack.

These and/or other features and objects will be understood from the following detailed description, and the enclosed drawings, of certain embodiments of the invention.

DETAILED DESCRIPTION OF CERTAIN EMBODIMENTS

Figure 1:
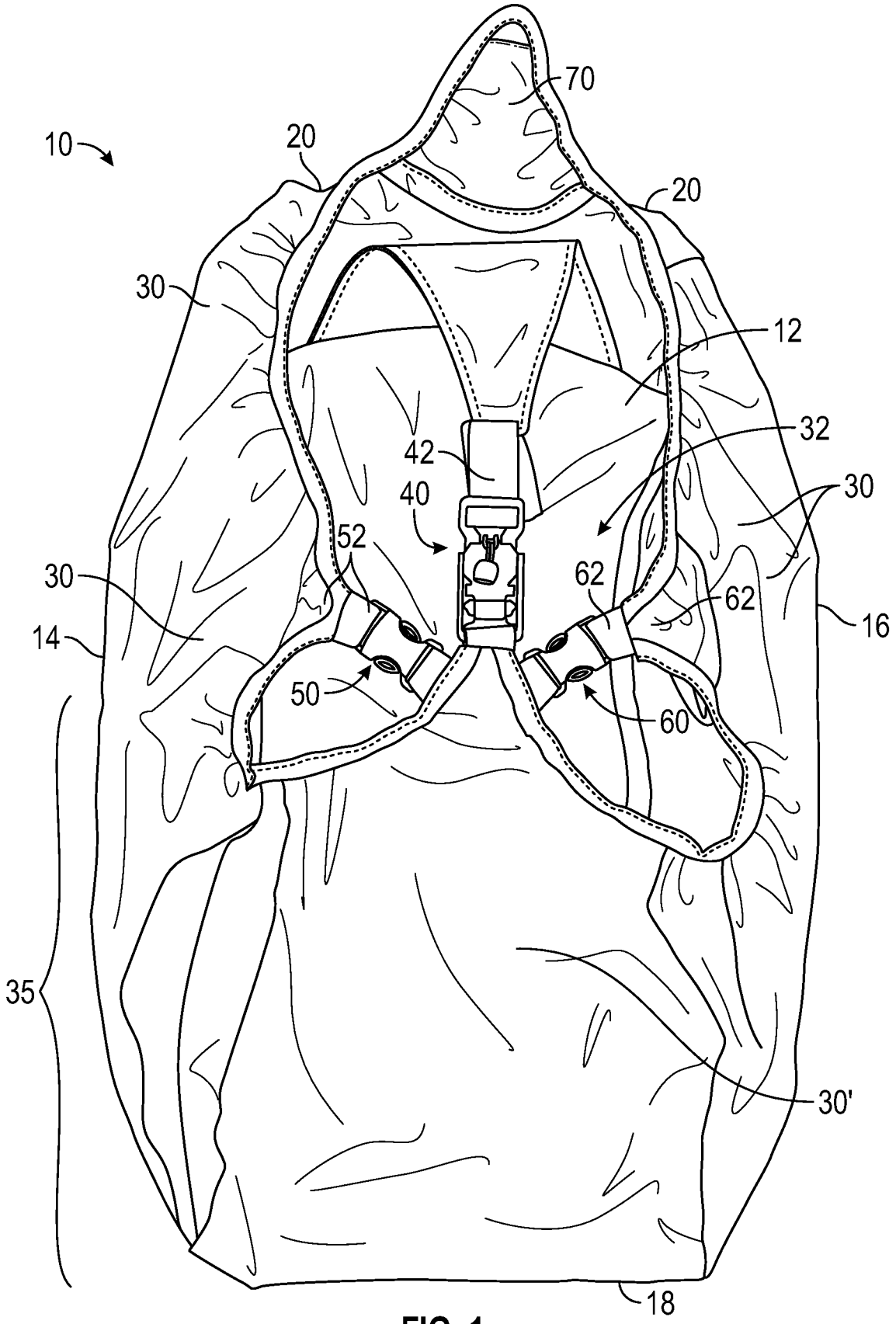
FIG. 1 is a front view of one embodiment of the invented cover, un-installed from any backpack, with the cover latches in latched condition and an embodiment of top handle flap unfastened/disconnected from the top latch extension/strap.

Referring to the Figures, there are shown multiple, but not all, of the embodiments of the invented cover for use with a backpack. In this document, for ease of description, the "front" of the backpack and the "front" of the cover are the sides that are toward/against the user's back when the user is wearing the backpack by putting the user's arms and shoulders through the two should straps of a conventional backpack. The "back" of the backpack and the "back" of the cover are opposite of the front, that is away from the user when thus worn.

The cover 10 comprises a main body formed preferably of flexible fabric that is formed to create "an envelope" and/or "a pouch" that can enclose and cover back, right, left, bottom and top of the backpack 300. For example, the main body comprises back panel 12, right side 14, left side 16, bottom end 18 and top end 20 of the cover 10, wherein the main body extends forward and around the backpack from said right and left sides 14, 16, bottom end 18 and top end 20 to form a front side 30 that covers part/portions of the front side of the backpack. At the front side 30 is an opening 32 that, when the latches 40, 50, 60 of the cover 10 are unlatched, can receive the backpack through the opening 32, for subsequent re-latching to secure the cover 10 around the backpack 300.

FIG. 1 shows the cover 10 by itself, un-installed and separated from any backpack 300, with the three latches 40, 50, 60 in latched condition. At the top end 20 of the cover 10 is a top handle flap 70 that, in FIG. 1, is disconnected from the top latch extension 42 and raised upward to distance it from the extension 42, as will be further described below.

Each of the three latches 40, 50, 60 are preferably quick-connect and quick-disconnect latches. Said latches 40, 50, 60 are preferably chosen/adapted so that that operation of the latches is quick and simple and does not require significant manipulation of the backpack or any portion of the cover except the latches 40, 50, 60 and/or the adjacent extensions/portions 42, 52, 62 of the cover to which the latches 40, 50, 60 are attached. For example, the top latch 40 comprises magnetic-assisted latching, which may be: 1) latched by placing the latch 40 magnetized portions 46, 48 near each other (with one or two hands) so that the magnetic attraction pulls the two portions 46, 48 into a latched condition shown in FIG. 1; and 2) unlatched easily by pivoting (with one hand) the latch handle 44 of the handle portion 46 away from the cooperating latch portion 48, which moves the two portions 46, 48 from each other to disrupt the magnetic connection of the two magnetic portions 46, 48, as in FIGS. 2 and 3. For example, top latch 40 may be an embodiment of a FIDLOCK™ latch/fastener, with magnetic portions/components that attract each other to automatically latch when the components are brought close together, and that release when a handle or other actuator pulls/pushed the components apart. Thus, such a latch/fastener may be called a "magnetically-assisted" latch/fastener. With such a latch/fastener, one hand may accomplish the latching and also the unlatching, while the other hand holds the cover/backpack combination or simply while the combination rests on a table or floor, for example. Such latches/fasteners are available commercially from Fidlock GmbH, Germany (HindenburgstraBe 37 30175 Hannover) under the name FIDLOCK™, and are described at https://www.fidlock.com/en/. Alternatively, in certain embodiments, latch 40 may be selected from other types of fasteners/connectors; for example, latch 40 may be a side release buckle such as drawn in the Figures for latched 50 and 60.

The right and left latches 50 and 60 connect the right and left sides 14, 16 of the cover to a lower portion of the front side 30 of the cover, in effect, extending across the cover opening 32 and connecting the right and left sides securely and snugly to the lower portion 30' of front side 30. Thus, especially in the latched configuration, the main body extends around the bottom end and up about midway along the front side of the backpack 300, creating a relatively large lower pouch 35 in which the bottom end of the backpack 300 can rest/sit. See FIGS. 1 and 4. When the backpack 300 is installed in the cover, as in FIG. 4, this relatively large lower pouch 35, combined with the extensions/straps 42, 52, 62 and their latches 40, 50, 60, serve to capture and substantially enclose the backpack 300. Said extensions/straps 42, 52, 62 and their latches 40, 50, 60 close/block portions of the opening 32 to reduce the effective size of the opening 32, holding the cover 10 on the backpack 300 so that the backpack does not fall out or away from the cover.

Figure 4:
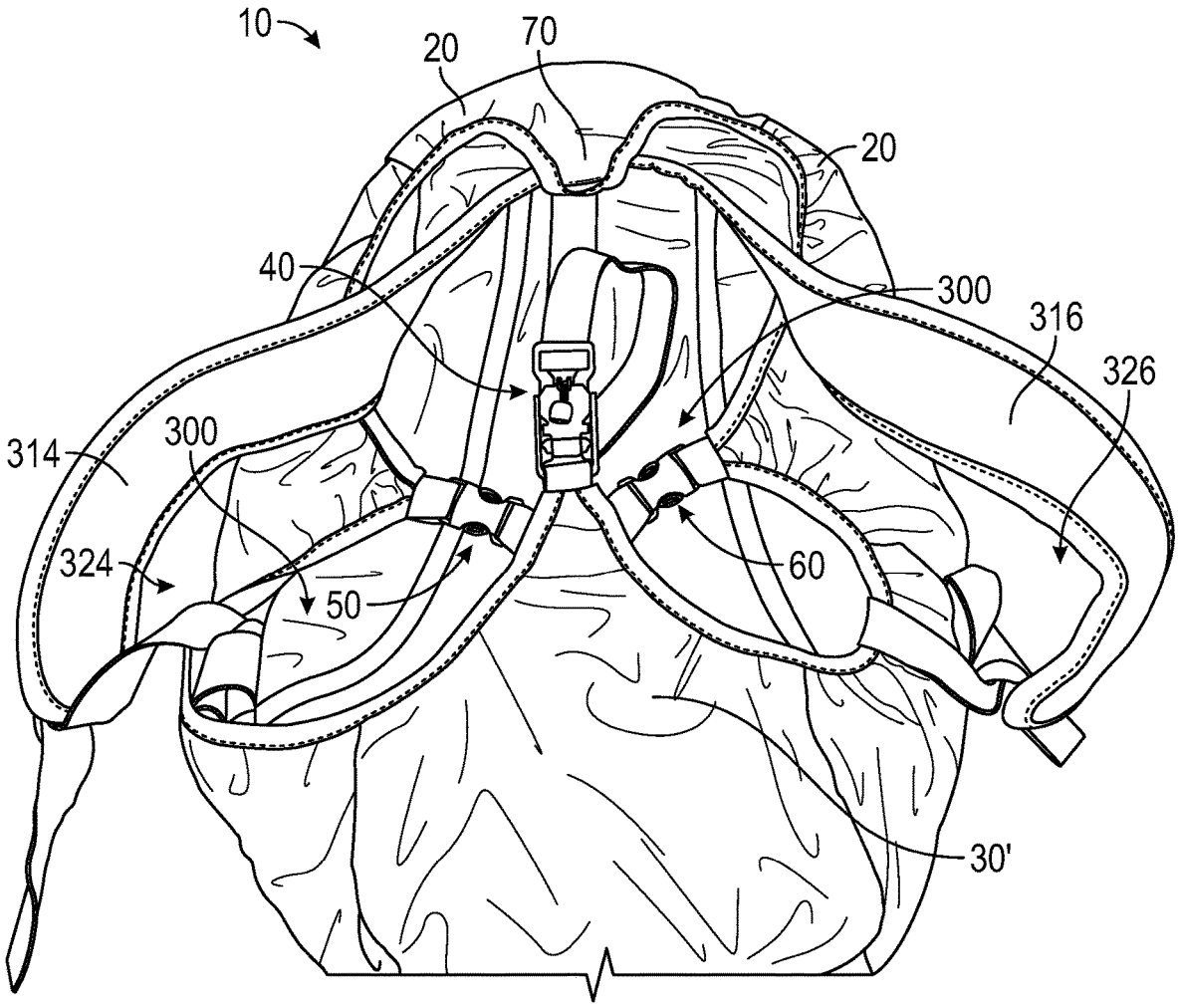
FIG. 4 is a front view of the cover of FIG. 1, after being placed around an exemplary backpack, with the three cover latches latched and with the backpack shoulder straps pulled out to extend forward from the cover for use of the covered backpack. In this view, the top handle flap extends forward up and over the exemplary top backpack handle and is fastened/connected to the top latch extension/strap, to cover and hide the backpack handle.

From FIG. 4 and the above description, the connections/securements at the front side of the cover and backpack combination will be understood as effectively and securely keeping the cover on the backpack to substantially envelope the backpack. Due to some areas of the front of the cover being open (32) even when all latches are latched, it may be said that 70-99 percent of the backpack is covered, with the opening(s) 32 making 1-30 percent of the backpack (preferably only at the front) technically uncovered. More preferably, 75-90 percent of the backpack is covered, with the opening(s) 32 making 10-25 percent of the backpack (preferably only at the front) technically uncovered. Elastic may be optionally added on/in the edges of the cover defining the opening(s) 32, if desired, which addition would tend to elastically reduce the size of the opening 32 if the size of the backpack allowed.

The extensions/straps 42, 52, 62 may be adjustable in length, for example, with conventional backpack or strap adjustors, and/or elasticity may be provided in the fabric cover and/or its edges. These features may be beneficial for making certain embodiments of the cover universally-fitting on a variety of sizes of back-packs, and/or this may be beneficial to make the cover tighter-fitting on any backpack chosen by the user. It should be noted that each latch and its respective extension/strap, or other connector/connection to the main body of the cover (for example, to the right side, left side, top end/upper end, of the main body), may each be called a "latch system", for example, a right latch system (50 and 52), a left latch system (60 and 62) and a top latch system (40 and 42, and or 40 and 170 as in FIG. 12).

Latches 50 and 60 are typically unlatched less frequently than latch 40, and so are not necessarily the same type/style of fastener/connector as latch 40. Preferably, however, latches 50, 60 are both quick-connect and quick-disconnect and both the same style/type in order to provide symmetry and convenient use at the right and left sides of the cover. For example, latches 50, 60 may be strap buckles such as those well-known in backpack and other outdoor and recreational fields, for example, those known commonly as "side-release buckles". Such buckles may be operated easily, for example: 1) latching of each buckle typically by pushing with one hand the side-release male portion 56, 66 of the buckle 50, 60 into the female portion 58, 68 of the buckle that is held/stabilized by the other hand, where-after the resilient side-release portion is released by the user so that it expands to latch the buckle, as in FIG. 1; and 2) unlatching the buckle 50, 60 typically by one hand squeezing the side-release male portion 56, 66 of the buckle and pulling that portion 56, 66 away from the respective female buckle portion 58, 68, as in FIG. 3. Alternatively, in certain embodiments, latches 50, 60 may be selected from other types of fasteners/connectors; for example, latches 50 and 60 may also work by magnet connection, such as a FIDLOCK™ fasteners/connector described above.

Figure 3:
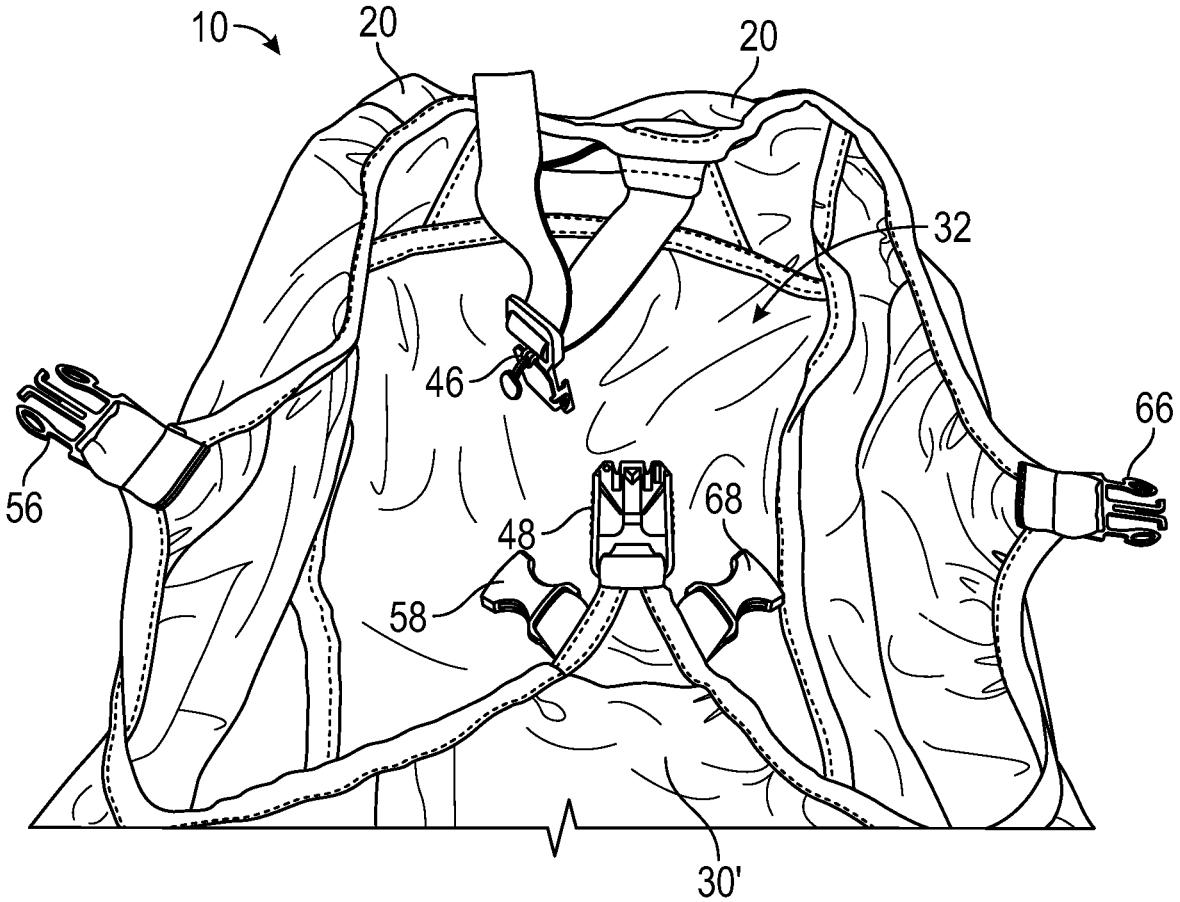
FIG. 3 is a front view of a portion of the embodiment of FIG. 1, with all three front latches unlatched and the cover being opening-up, for example, for placement around a backpack.

With all three latches 40, 50, 60 disconnected (unlatched), as in FIG. 3, the backpack 300 may then be inserted into the opening 32, with the bottom end of the backpack in the pouch 35 at/in the bottom of the cover, and the right, left and top sides 14, 16, 20 pulled around to the front side of the backpack, as in FIG. 4. An important note regarding this installation and FIG. 4 is that, for the intended carrying of the backpack on the shoulders/back of the user, the shoulder straps 314 and 316 are left out or pulled out from the opening 32, prior to latching of the two bottom (right and left) latches 50, 60. The latches 50, 60 and their respective extensions/straps 52, 62 are then inserted between the shoulder straps 314, 316, respectively, and the front of the backpack 300, in other words through the respective shoulder straps 314/316 (through loop openings 324, 326) and subsequently latched. See FIG. 4. This provides further security, by connecting the right and left sides 14, 16 to the lower portion 30' of the front side 30 of the cover 10 through the shoulder straps, as this further ensures that the cover cannot be easily or quickly pulled off the backpack 300 to reach the backpack and/or open the backpack and access its contents, either when the user is carrying the combination of backpack 300 and cover 10, or when the user has removed the combination from the user's back and shoulders, is carrying the combination, and/or has set the combination down.

In certain embodiments, a locking mechanism may be added to one or more of the latches, for example, so that the latch(es) can only be unlatched by the authorized user. For example, a locking mechanism such as a keyed lock, a digital lock with unlocking code, or a finger-print, voice, or other authorized-user recognition system, may be provided. In certain embodiments, a cutting/slashing-resistant fabric may be used for the cover to help prevent the cover from being removed by an unauthorized person.

Figure 2:
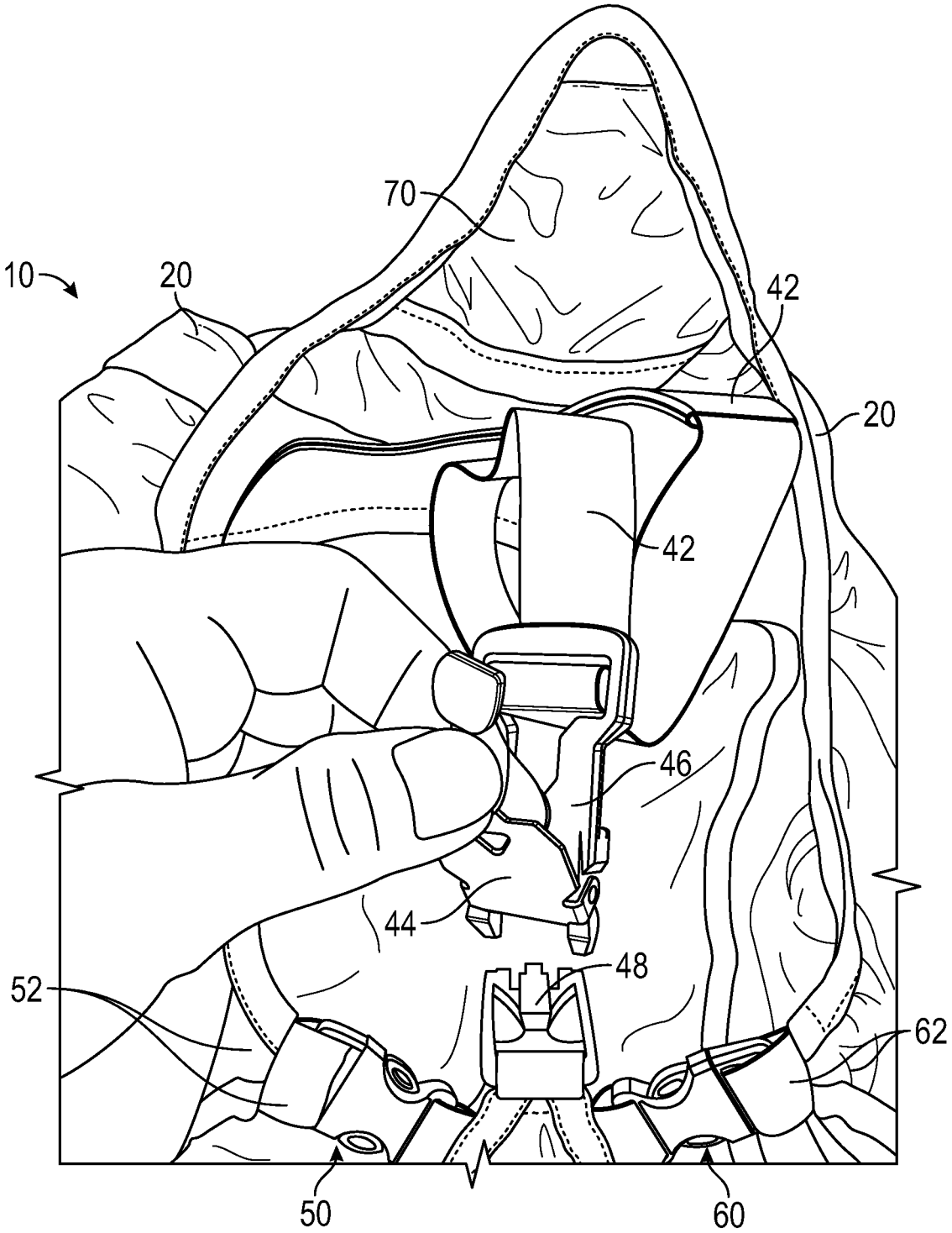
FIG. 2 is a front view of a portion of the embodiment of FIG. 1, wherein the top latch is being unlatched by a user.
Figure 9:
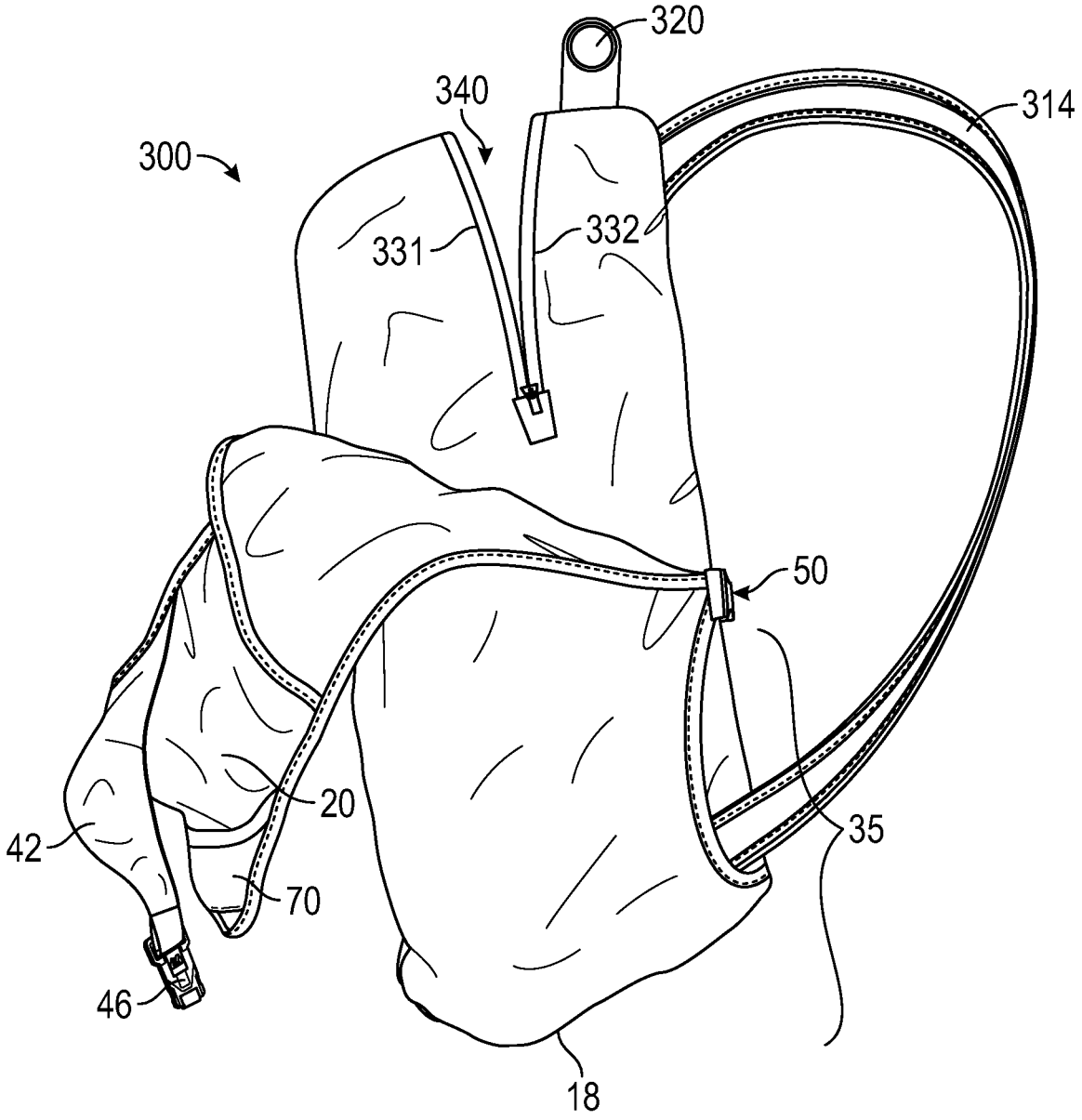
FIG. 9 is a side view of the cover and backpack combination of FIG. 4, after the top handle flap is lifted away from the top latch extension/strap, the top latch is unlatched, and the top end of the cover is pulled back from the upper end of the backpack for access to the top end opening of the backpack, all without unlatching the lower two (right and left side) latches and without removing the sides and bottom end of the cover from the backpack.

As may be understood from FIGS. 1, 2 and 4, the flap 70 may be a portion of the top end 20 that extends forward over the handle 320 when the user desires to cover the handle 320 so that substantially all of the backpack 300 is covered, for example, to prevent access to the handle 320 and/or to prevent rain or dirt from reaching the handle or zipper of the main backpack opening (zipper 321, 322 in FIG. 9). Thus, flap 70 may be integral with the top end 20 and may be considered a generally triangular extension of the top end 20. The top latch extension/strap 42 is so-called because it may be a panel of material and/or a strap (in the preferred embodiments, both, as shown to best advantage in FIGS. 1-3), that is secured to, and/or otherwise extends from, an inside surface of the back side 12 of the cover 10, below the top end 20. For example, in FIG. 1, one may see that extension/strap 42 is stitched or otherwise fixed to the inside surface about 3-5 inches from the top end 20. The extension/strap 42 is preferably generally triangular or otherwise relatively narrow at its distal end that holds the top latch 40, so that it fits through the space created between the handle 320 and the upper end of the backpack. See FIG. 7. Thus, the extension/strap 42 extends through the handle 320, forward across the upper end of the backpack under the handle, and extends to, and fastens to, cooperating latch portion 48 of latch 40. This supplements the latch system of multiple latches at the front of the cover and backpack combination, to further center the cover on the backpack, and to further secure the top end of the cover on the backpack when the top latch 40 is latched.

To retain flap 70 in the desired position over, and covering, the handle 320, a detachable/unlatchable fastener is preferably provide to temporarily fasten the flap 70 to the extension/strap 42. This fastener may be, for example, a magnetic fastener/connection, such as provided by a magnet 79 being provided on or preferably inside the flap 70 and a cooperating magnet 49 being provided on preferably inside extension/strap 42. See the dashed-line circles denoting magnets 79 and 49 in FIG. 7. This way, when flap 70 is moved across the handle 320 and the flap 70 distal end is dropped or otherwise placed near the extension/strap 42, the flap magnet 79 will be attracted by and magnetically connect to the magnet 49 on extension/strap 42, to hold the flap 70 in the desired location shown in FIG. 4. Other fasteners may be used for this detachable/unlatchable fastener, such as hook and loop fastener(s), but a magnetic connection is preferred because it is expected to operable with one hand and/or to be durable and reliable over time.

Figure 5:
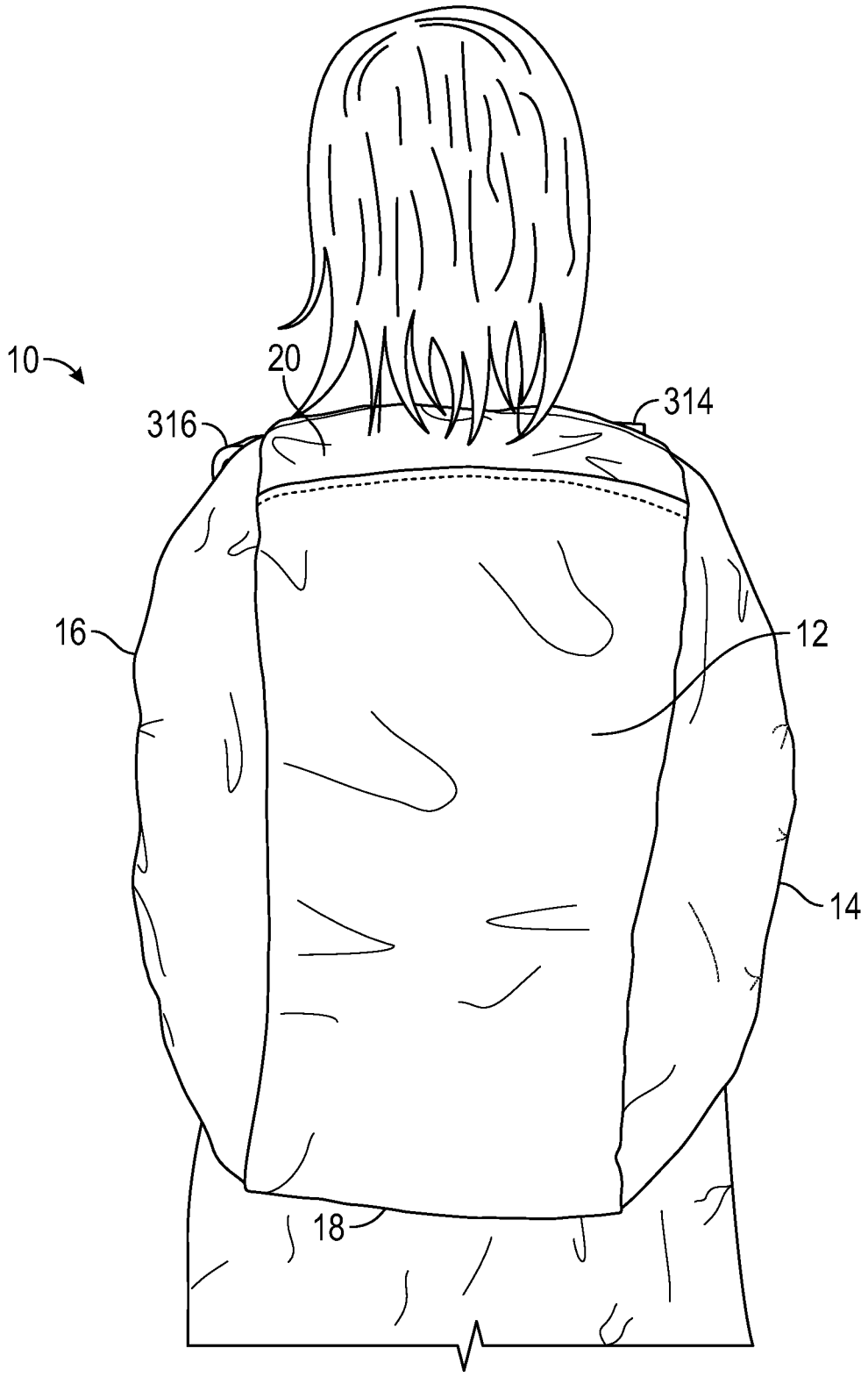
FIG. 5 is a back view of the cover and backpack combination of FIG. 4 being worn by a user, wherein the front of the combination is against the back of the wearer, and the back, right and left sides, top and bottom of the backpack are covered by the cover, so that the backpack is not visible in this view.
Figure 6:
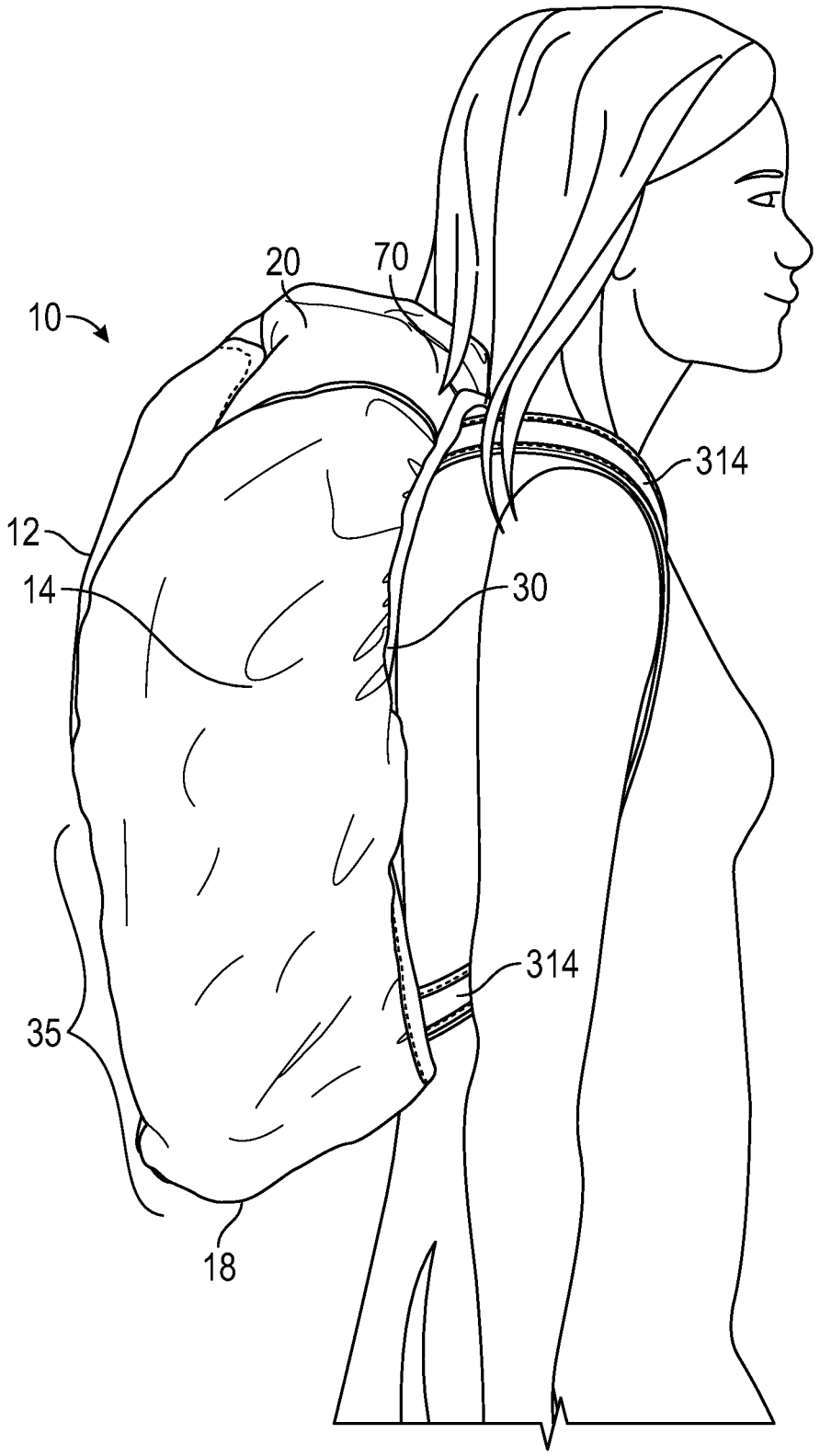
FIG. 6 is a side view of cover and backpack combination of FIGS. 4 and 5, showing how the backpack is being worn by the shoulder straps extending around the user's shoulders as is conventional for most backpacks, and how the front of the cover and backpack are against the user's back and so not visible or easily accessible.

FIGS. 5 and 6 illustrate use of the cover and backpack combination on the shoulders and back of the wearer. The left side view of the combination on the wearer would be a mirror image of FIG. 6. Thus, with the shoulder straps 314, 316 extending out form the opening 32 at the front of the combination, the covered backpack may be worn and carried in a conventional manner, with the sides/surfaces of the backpack at the back, right side, left side, top and bottom of the backpack being preferably entirely covered by the cover 10. The front side of the backpack is substantially covered by the front side 30, 30' of the cover 10, but the front side of both backpack and cover are against the user's back and hidden from onlookers and substantially or entirely inaccessible by other parties, for example passers-by and/or adjacent walkers or travelers. Further, this way, the openings, pockets and zippers or other fasteners of the backpack are substantially or entirely inaccessible by said other parties. This way, the chance of theft, vandalism, or loss of the backpack or its contents are greatly reduced. From FIGS. 5 and 6, it may be noted that the preferred cover 10 extends all across the back, right and left sides, top and bottom of the backpack, preferably continuously and without apertures or openings. For example, most preferably, the cover 10 extends along/covers 100 percent of the back, right and left sides, top and bottom of the backpack, or in certain alternative embodiments, at least 80 percent, or at least 90 percent, of the back, right and left sides, top and bottom of the backpack. As understood from FIGS. 5 and 6, the cover 10 extends entirely or substantially entirely to the back, shoulders or neck of the wearer, and the latches 40, 50, 60 are hidden at the front of the combined cover and backpack that is against the wearer's back. Further, there are preferably no tabs, straps, cords, or other items extending from or hanging from the outer surface of the cover at its back, right, left, top or bottom sides, so that there are no tabs, straps, cords, or other items extending from or hanging that might be caught on adjacent objects, grab-able by a passer-by or other unauthorized person, and/or otherwise a potential danger in public or on a train or public transport.

Figure 7:
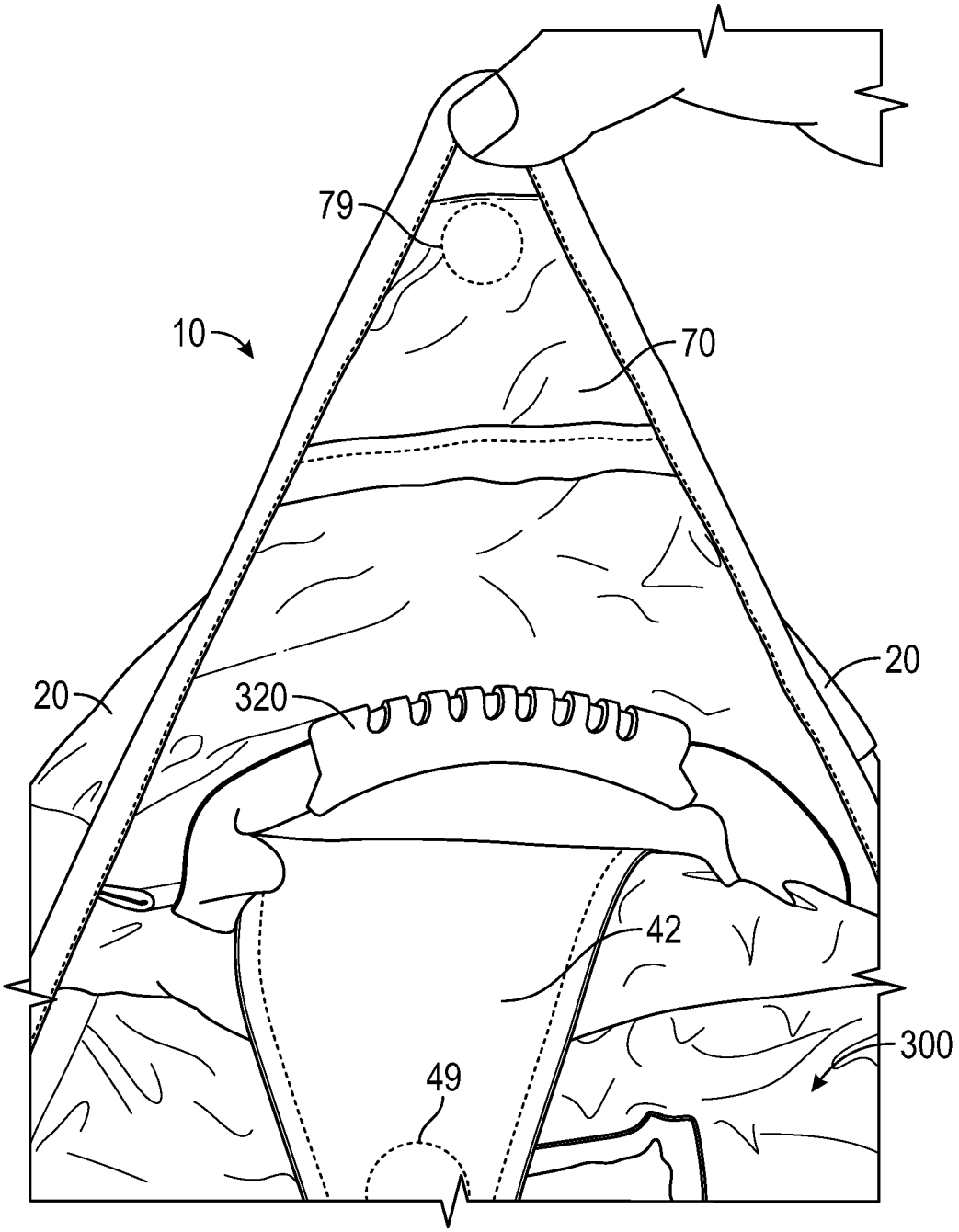
FIG. 7 is a front view of a portion of the cover and backpack combination of FIG. 4, removed from the user's shoulders and back, wherein the top handle flap is unfastened/disconnected from the top latch extension/strap and lifted to reveal the backpack handle.
Figure 8:
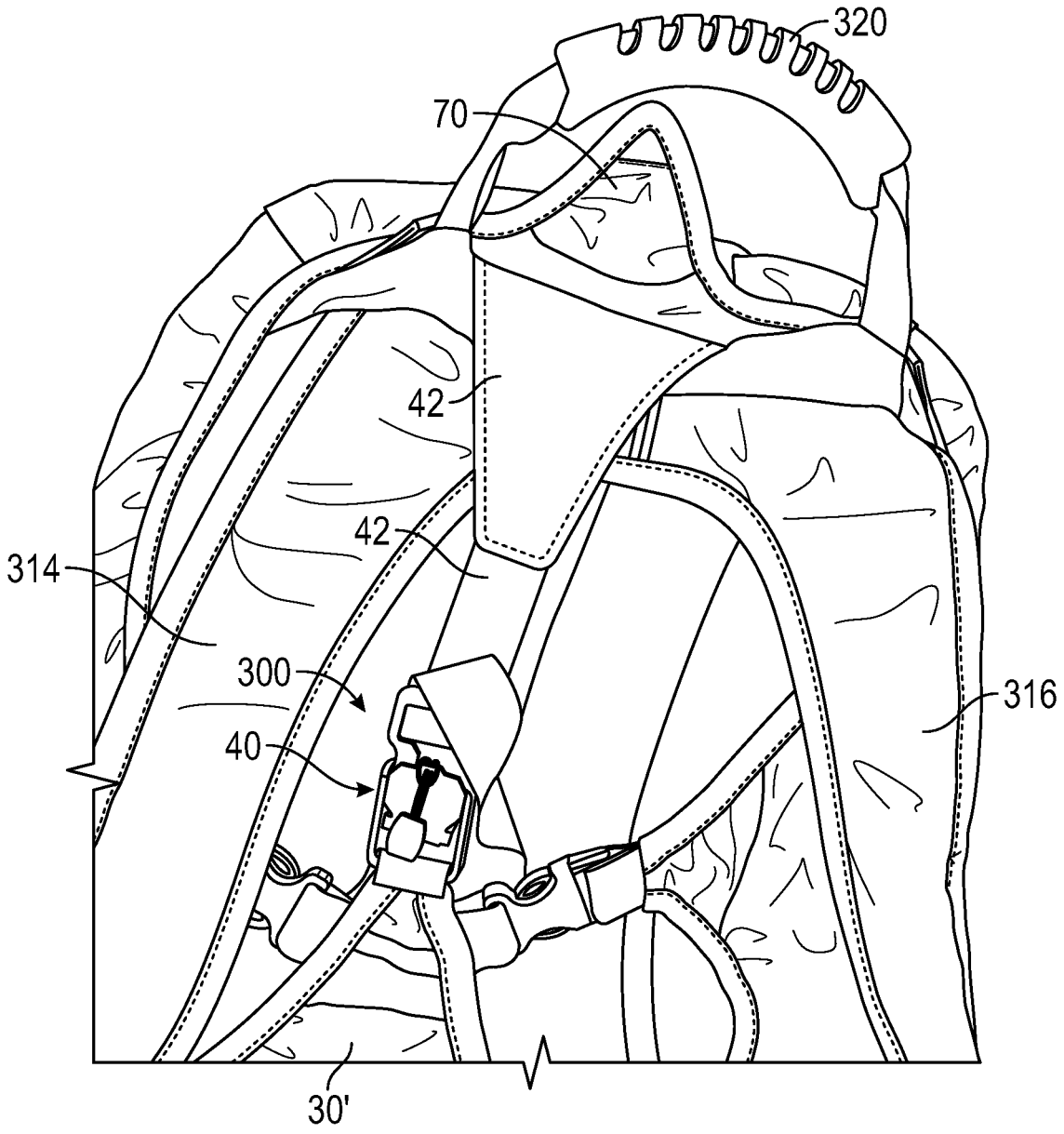
FIG. 8 is a front view of a portion of the cover and backpack combination of FIG. 4, wherein the top handle flap is lifted away from the top latch extension/strap to expose the handle for carrying the combination by the handle, without unlatching any of the latches of the front grouping of latches and without removing any portion of the cover from the backpack except said lifting of the top handle flap.

When removed from the wearer's shoulders and back, as in FIGS. 7 and 8, the user may choose to carry the covered backpack, preferably by leaving all of the latches 40, 50, 60 latched, and simply by lifting the flap 70 away from the magnetic connection (79, 49) to access the handle 320. This keeps the backpack 300 substantially covered, and allows for easy and safe carrying by means of the handle 320.

When; the user wishes to access contents of the backpack 300, as in FIG. 9, the user may lift the flap 70 away from extension/strap 42, unlatch top latch 40, and pull flap 70 and extension/strap 42 and/or top end 20 back away from the backpack upper end. This is preferably done with the lower two (right and left) latches still latched, so that about the lower half of the backpack stays covered and securely in the lower region ("pouch" area 35) of the cover. The fabric of about the top half of the cover 10 will fold and/or crinkle to uncover the upper end of the backpack, revealing the upper end and its conventional upper, main backpack opening. The fastener(s)/closure(s) of that main backpack opening, typically a zipper 321, 322, is thereby accessible to the user, for opening the top end and accessing contents of that main compartment of the backpack through backpack opening 340. See, in FIG. 9, that the cover remains over about the bottom half of the backpack, while the user can unzip and reach into the opening 340 to check on, insert, or remove items. After this access to the interior of the main compartment of the backpack (which will be understood by those familiar with a conventional backpack, for example), the user can pull the top end 20 and the extension/strap 42 and flap 70 forward again over the upper end of the backpack re-insert the extension/strap 42 through the handle and relatch top latch 40, and optionally re-latch the magnetic fastener 79, 49 of the flap 70. Therefore, cover 10 allows access and use of the backpack, without removing the cover 10 to any extent for use on the shoulder and back, and without removing half or about half of the cover for access to the backpack interior. Note that all this use, in preferred embodiments, may be accomplished without drawstrings and without covering/making-inaccessible the shoulder straps, and without difficult or time-consuming manipulation of the cover or the backpack. It is preferred that the cover does not comprise drawstrings, for example, preferably no drawstrings extend through or along the edges of the opening 32, and preferably no drawstrings are used to open or tighten the opening 32. Optionally, elastic/elasticity may be provided in the fabric, and/or on the edges of fabric around the opening 32, if desired, as described above.

Figure 10:
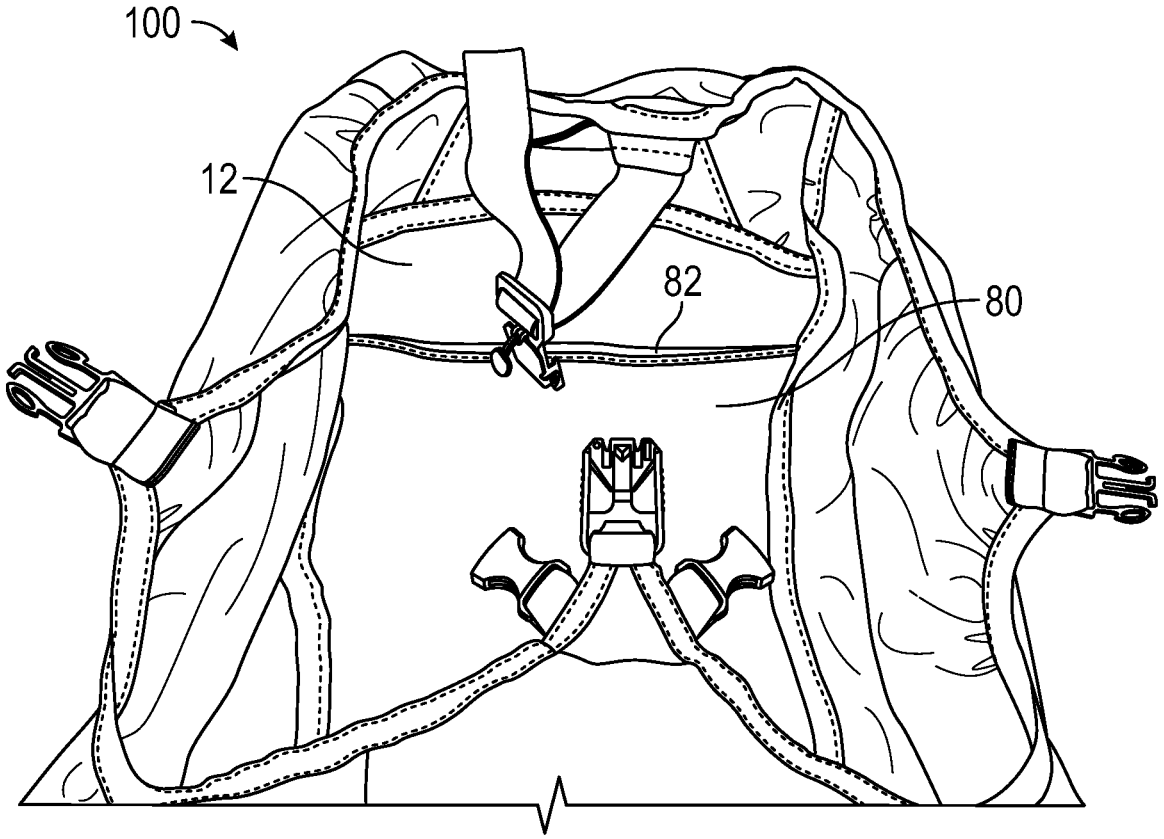
FIG. 10 is a front view of a portion of an alternative embodiment of the invented cover, with the latches unlatched and the cover un-installed from any backpack, showing an embodiment of an internal pocket on the inside back surface of the cover.

FIG. 10 illustrates an alternative embodiment, cover 100, that may be the same or similar to cover 10, except that it includes an internal pocket 80 for holding or containing objects that user wishes to store in the cover rather than the backpack. Such objects may be a passport, driver's license, or other important documents, money, medicine, or keys, for example. The pocket 80 preferably opens at its top end, for example, with opening 82. Fasteners (not shown) may be added to close the opening if desired. The illustrated internal pocket 80 is provided on/in an inner/inside surface of the back side 12.

Figure 11:
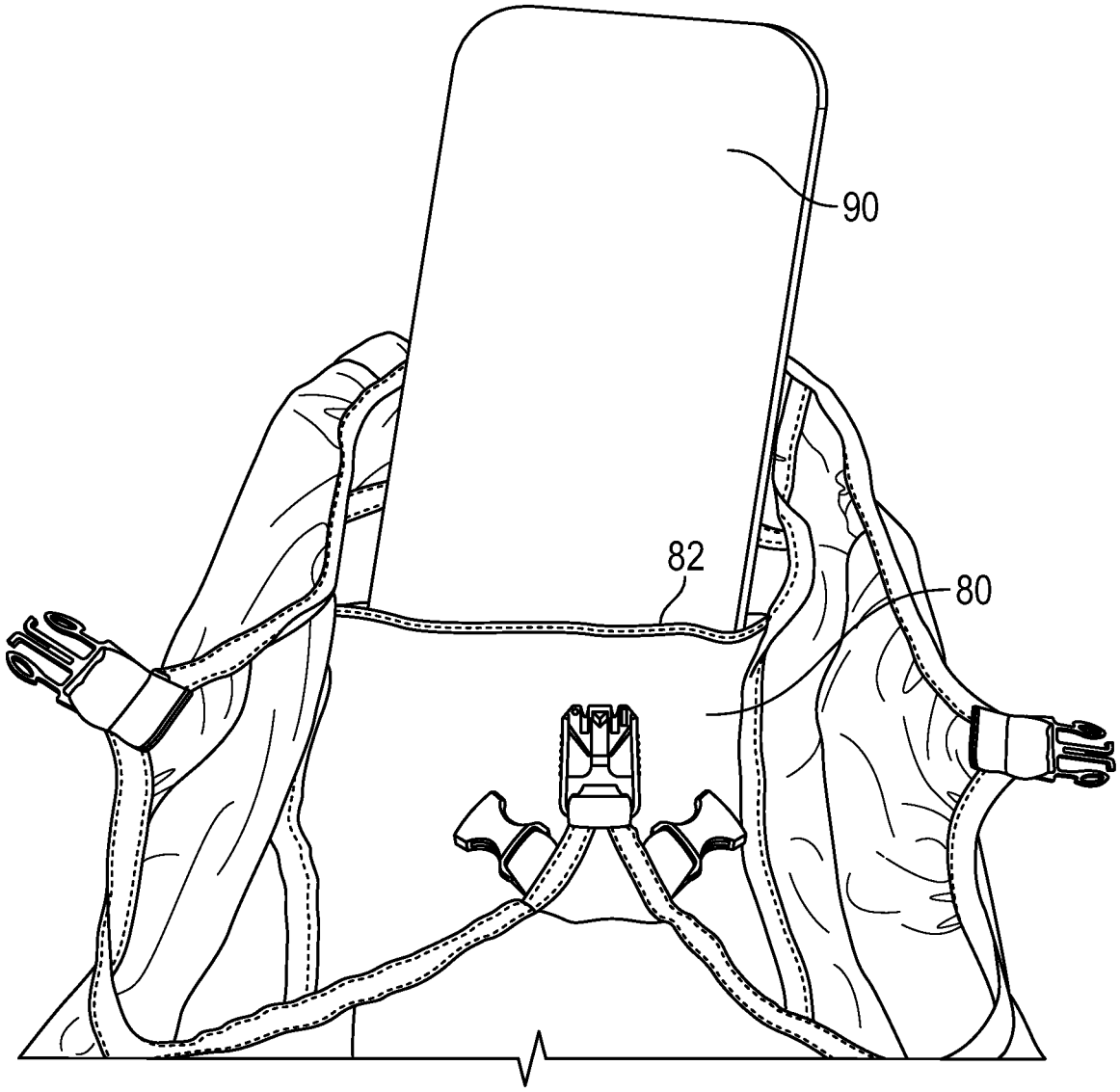
FIG. 11 is a front view of the embodiment of FIG. 10, with an embodiment of a bullet-resistant or bullet-proof pad being inserted into the internal pocket.

FIG. 11 illustrates an object being inserted through opening 82 into pocket 80, for example, a bullet-resistant or bullet-proof pad or plate 90, so that the cover adds a good measure of safety and protection to the combination of cover and backpack and the user, as the combination may be worn or held against the user in a way that may shield the user's torso from bullets or other weapons. This way, when the environment is safe and the shielding is not require or desired, the pad or plate 90 is removable and storable separate from the cover and from the backpack. For such a shielding use, or to contain and carry large items in the pocket 80, the pocket may be the same, or nearly the same size at the back side 12 of the cover. For example, the pocket and its interior may be sized so that they extend across 80-100 percent of the back side 12, or more preferably across 90-100 percent of the back side 12, and therefore across 80-100, or 90-100, percent of the back of the backpack.

In certain embodiments, in addition to or instead of a pocket on the back side 12, one or more pockets may be provided on/inside the front side 30 of the cover. For example, one or more pockets could be provided on the inner surface of the lower portion 30' of the front side 30, that is, below latches 50 and 60 and below the opening portions (32) that are created by, and below, latches 50, 60. Such a pocket may be made to be about the width of the lower portion 30' and about the height, or slightly less than the height, of the lower portion 30' from the bottom of the cover up to said opening portions (32) that are created by latches 50, 60. Such a pocket (not shown) could be open-topped or have a closure, and would be effective for receiving and providing quick access to the user, to store or retrieve personal belongings, a flight ticket or a phone, for example. The user could access this pocket by reaching into the opening 32, or an opening portion (32), and into the pocket, between the lower portion 30' and the backpack 300. The user could temporarily unlatch one or more of the latches 40, 50, 60 to get better access to the inner/inside pocket, if desired, but would not need to remove the cover from the backpack. When wearing the cover and backpack combination, the lower portion 30' and its inner/inside pocket and its contents would be facing/on the user's back and so would be secure and inaccessible to others.

Figure 12:
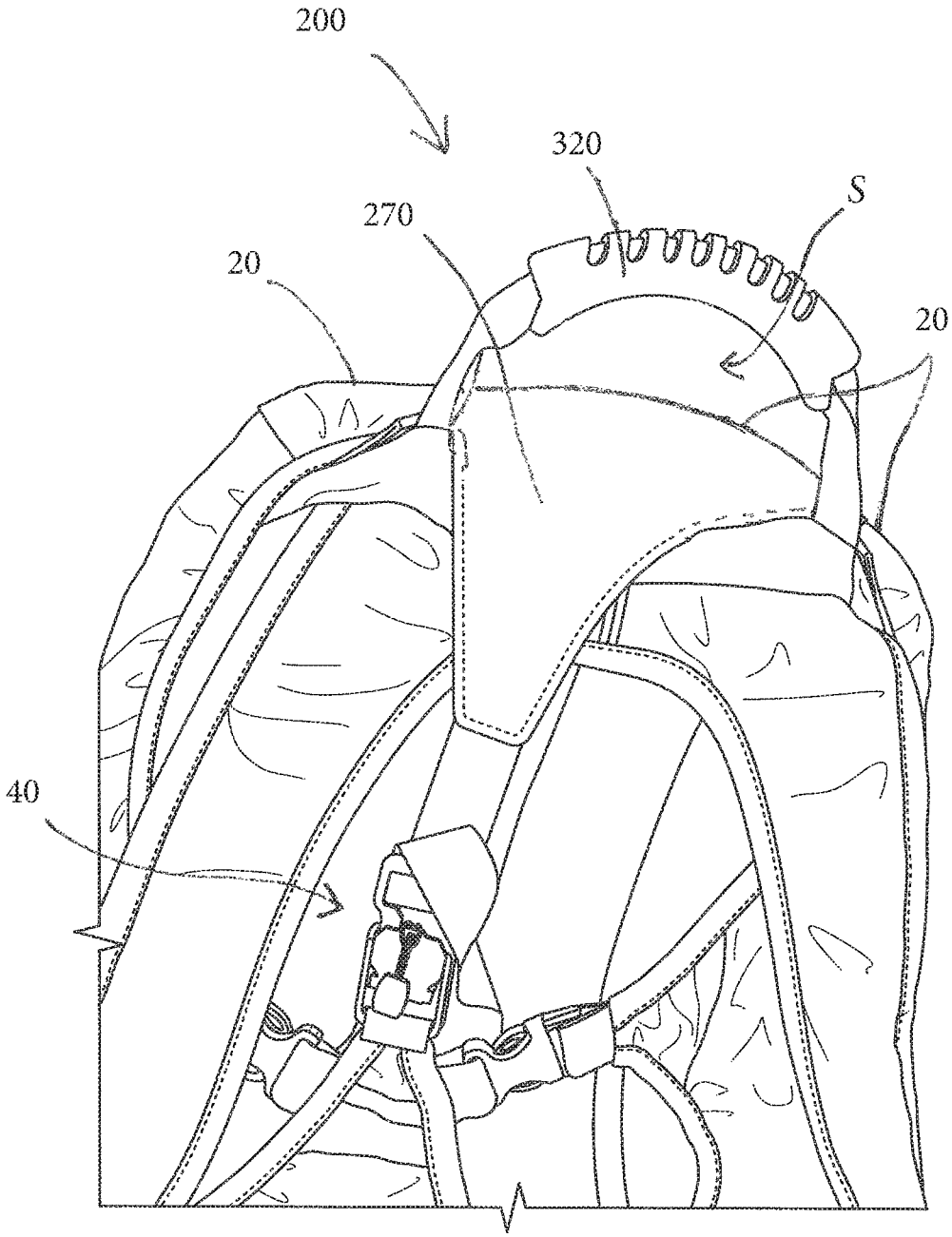
FIG. 12 is front view of a portion of an alternative cover installed on the backpack, an extension of the top end of the cover holds at its distal end a portion of the top latch, which extension extends forward through the handle space and down to the cooperating portion of the top latch that is connected to the lower portion of the front side of the cover, to center and secure the top end of the cover to/around the backpack as understood from the description herein of other embodiments of the cover.

FIG. 12 is front view of a portion of an alternative cover 200 installed on the backpack, which alternative cover 200 may be the same or similar to covers 10, 100 except for having an alternative top end centering and securement system. Specifically, the description in this document and its drawings for covers 10, 100 may be understood to apply to certain embodiments of this cover 200, except for the alternative top end centering and securement system. Specifically, instead of a top latch extension/strap 42 that extends from an inner surface of the cover 10, 100 and that extends through the handle space S, and a flap 70 that extends over the handle, cover 200 uses an extension 270 (also called a "top extension") of the top end of the cover 200 but not a handle-covering flap. Extension 270 may be integral with the top end of the cover, and/or may be a separate piece that is stitched or otherwise fixed to the top end of the cover. Extension 270 extends through the handle space S, and, at its distal end, holds a portion of the top latch 40 for latching to the cooperating top latch portion on the lower portion of the front side of the cover. Extension 270 is preferably a generally triangular shape and/or otherwise sufficiently narrow at least nearer its distal end to fit easily and aesthetically through the handle space S. This way, this extension/strap 270 centers and secures the top end of the cover to/around the backpack, as understood from the description herein of other embodiments of the cover. Therefore, cover 200 uses the cover top end fabric, or an extension secured to the front-center edge of the cover top end fabric, for example, for top end centering and security, instead of an extension/strap (42) that is separate from and supplemented with a flap 70 that is substantially only for covering the handle.

Extension 270 may alternatively be placed forward above and over the handle and down to the cooperating top latch portion on the lower portion of the front side of the cover, rather than through the handle space S. This may be done, for example, if covering/enclosure of the upper end and handle of the backpack is desired, for example, if protection from dirt, from weather, from catching the handle on other objects, or from other parties grabbing the handle is more important to the user than the centering and security of having the extension/strap 270 extend through the handle space S.

Although this invention has been described above with reference to particular means, materials and embodiments, it is to be understood that the invention is not limited to these disclosed particulars, but extends instead to all equivalents within the scope of the following claims.

The invention claimed is:

1. A cover and backpack combination, the cover comprising:

a main body for substantially covering the backpack, the main body having a back panel, right side, left side, bottom end, top end, and front side, wherein portions of the back panel, right side, and left side, and a lower portion of the front side, form a pouch receiving a bottom of the backpack;

wherein the front side of the cover comprises one or more openings, and right and left shoulder straps of the backpack extend through the one or more openings for being carried on shoulders of a user;

wherein multiple latch systems are provided at the front side of the cover and are adapted to connect and latch together the right side, the left side, the lower portion of the front side, and a top portion of the front side, to hold the cover on the backpack;

said multiple latch systems comprising a right latch system that extends from the right side of the cover through the right shoulder strap to said lower portion of the front side, a left latch system that extends from the left side of the cover through the left shoulder strap to said lower portion of the front side, and a top latch system that extends through a handle of the backpack to said lower portion of the front side, for securing the cover to the backpack including during the backpack being carried by a user by the shoulder straps being on shoulders of the user.

2. The combination of claim 1, wherein all of the right latch system, left latch system, and top latch system are between the backpack and a back of the user during the backpack being carried by the user by the shoulder straps being on shoulders of the user.

3. The combination of claim 1, wherein each of the multiple latch systems has a latch on the front side in an area of the front side that is less than 7 inches in height and less than 7 inches in width, so that the latches are generally centered on the front side, close together, and distanced from the right side, left side, top end and bottom end of the cover.

4. The combination of claim 1, wherein the top latch system comprises an extension fixed to an inner surface of the cover that extends through the handle.

5. The combination of claim 4, wherein a quick-connect and quick-disconnect top latch is attached to a distal end of the extension fixed to said inner surface.

6. The combination of claim 5, wherein the cover further comprises a flap extending from the top end of the cover, forward over the handle, and disconnectably connecting to the extension.

7. The combination of claim 6, wherein said flap comprises a magnet that disconnectably connects to a magnet of the extension.

8. The combination of claim 1, wherein the top latch system comprises a top extension that extends from a front-central edge of the top end of the cover and that extends through the handle.

9. The combination of claim 8, wherein a quick-connect and quick-disconnect top latch is attached to a distal end of the top extension.

10. The combination of claim 1, wherein the multiple latch systems comprises latches selected from a group consisting of: a magnetically-assisted latch and a side-release buckle.

11. The combination of claim 1, wherein the top latch system comprises a magnetically-assisted latch, and the right latch system and the left latch system each comprise a side-release buckle.

12. A cover for a backpack, the cover comprising:

a main body for substantially covering a backpack, the main body having a back panel, right side, left side, bottom end, top end, and front side, wherein portions of the back panel, right side, left side, and a lower portion of the front side form a pouch for receiving a bottom of the backpack;

wherein the front side of the cover comprises one or more openings, for allowing right and left shoulder straps of the backpack to extend through the one or more openings for being carried on shoulders of a user;

wherein multiple latch systems are provided at the front side of the cover and are adapted to connect and latch together the right side, the left side, the lower portion of the front side and a top portion of the front side to hold the cover around the backpack;

wherein each of the multiple latch systems has a latch in a latch area of the front side that is less than 7 inches in height and less than 7 inches in width, so that the latches are close together and distanced from the right side, left side, top end and bottom end of the cover.

13. The cover as in claim 12, wherein the multiple latch systems comprise a right latch system that extends from the right side to the lower portion of the front side for extending through a right shoulder strap of the backpack, a left latch system that extends from the left side to the lower portion of the front side for extending through a left shoulder strap of the backpack, and a top latch system that extends to said lower portion of the front side for extending through a handle of the backpack, for securing the cover to the backpack including during the backpack being carried by a user by the shoulder straps being on shoulders of the user.

14. The cover of claim 12, wherein the cover further comprises a flap extending from the top end of the cover for covering the backpack handle, wherein the flap has a distal end adapted to disconnectably connect to the top latch system.

15. The cover of claim 14, wherein said flap distal end comprises a magnet that disconnectably connects to a magnet of the top latch system.

16. The cover of claim 12, wherein the top latch system comprises a quick-connect and quick-disconnect top latch.

17. The cover of claim 12, wherein one or more of the multiple latch systems comprises a magnetically-assisted latch.

18. The cover of claim 12, wherein one or more of the multiple latch systems comprises a side-release buckle.

19. The cover of claim 12, wherein the top latch system comprises a magnetically-assisted latch.

20. The cover of claim 19, wherein the right latch system and the left latch system each comprise a side-release buckle.

* * * * *